US011492914B1

(12) United States Patent
Quach et al.

(10) Patent No.: US 11,492,914 B1
(45) Date of Patent: Nov. 8, 2022

(54) ENGINE WITH COOLING PASSAGE CIRCUIT FOR AIR PRIOR TO CERAMIC COMPONENT

(71) Applicant: Raytheon Technologies Corporation, Farmington, CT (US)

(72) Inventors: San Quach, Southington, CT (US); Adam P. Generale, Dobbs Ferry, NY (US); Raymond Surace, Newington, CT (US); Lucas Dvorozniak, Bloomfield, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 36 days.

(21) Appl. No.: 17/080,969

(22) Filed: Oct. 27, 2020

Related U.S. Application Data

(60) Provisional application No. 62/932,534, filed on Nov. 8, 2019.

(51) Int. Cl.

| | |
|---|---|
| ***F01D 5/18*** | (2006.01) |
| ***F01D 9/04*** | (2006.01) |
| ***F01D 11/12*** | (2006.01) |
| ***F01D 25/12*** | (2006.01) |

(52) U.S. Cl.
CPC ..... *F01D 5/187* (2013.01); *F01D 9/041* (2013.01); *F01D 11/122* (2013.01); *F01D 25/12* (2013.01); *F05D 2240/12* (2013.01); *F05D 2240/55* (2013.01); *F05D 2240/81* (2013.01); *F05D 2250/185* (2013.01); *F05D 2260/232* (2013.01); *F05D 2260/606* (2013.01)

(58) Field of Classification Search
CPC ..... F01D 5/187; F01D 9/041; F01D 11/122; F01D 25/12; F05D 2240/12; F05D 2240/55; F05D 2240/81; F05D 2250/185; F05D 2260/232; F05D 2260/606
See application file for complete search history.

(56) References Cited

U.S. PATENT DOCUMENTS

| | | | | |
|---|---|---|---|---|
| 4,820,116 | A * | 4/1989 | Hovan | F01D 1/32 415/115 |
| 8,979,482 | B2 * | 3/2015 | Khanin | F01D 11/10 415/115 |
| 9,334,754 | B2 | 5/2016 | Khanin et al. | |
| 9,988,934 | B2 * | 6/2018 | Spangler | F01D 25/246 |
| 10,400,627 | B2 | 9/2019 | Ning et al. | |
| 2002/0148233 | A1 * | 10/2002 | Tiemann | F01D 5/187 60/806 |
| 2003/0035717 | A1 * | 2/2003 | Tiemann | F02C 7/185 415/115 |
| 2012/0134781 | A1 * | 5/2012 | Khanin | F01D 5/187 415/115 |
| 2012/0257954 | A1 * | 10/2012 | Chanteloup | F01D 5/187 415/115 |
| 2016/0230663 | A1 * | 8/2016 | Mizukami | F02C 7/14 |
| 2018/0135460 | A1 | 5/2018 | Barker et al. | |

* cited by examiner

*Primary Examiner* — Igor Kershteyn
(74) *Attorney, Agent, or Firm* — Carlson, Gaskey & Olds, P.C.

(57) ABSTRACT

A gas turbine engine includes a blade outer air seal, a ceramic vane, and a cooling passage circuit that extends through a first internal passage in the blade outer air seal and a second internal passage in the ceramic vane.

18 Claims, 3 Drawing Sheets

ENGINE WITH COOLING PASSAGE CIRCUIT FOR AIR PRIOR TO CERAMIC COMPONENT

CROSS-REFERENCE TO RELATED APPLICATION

The present application claims priority to U.S. Provisional Application No. 62/932,534 filed Nov. 8, 2019.

BACKGROUND

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

Components in the turbine section are typically formed of a superalloy and may include thermal barrier coatings to extend temperature resistance. Ceramic matrix composite ("CMC") materials are also being considered. CMCs have high temperature resistance. Despite this attribute however, there are unique challenges to implementing CMCs.

SUMMARY

A gas turbine engine according to an example of the present disclosure includes a blade outer air seal, a ceramic vane, and a cooling passage circuit that extends through a first passage of the blade outer air seal and through a second passage of the ceramic vane.

In a further embodiment of any of the foregoing embodiments, the ceramic vane includes radially inner and outer platforms and an airfoil section that extend there between, and further includes an interface seal sealing the cooling passage between the blade outer air seal and the radially outer platform.

In a further embodiment of any of the foregoing embodiments, the blade outer air seal is forward of the ceramic vane.

In a further embodiment of any of the foregoing embodiments, the ceramic vane includes radially inner and outer platforms and an airfoil section that extend there between, and the cooling passage circuit includes a first leg in the blade outer air seal and a second leg in the radially outer platform, where the second leg splits into a third leg in the airfoil section and a bypass leg that bypasses the airfoil section.

In a further embodiment of any of the foregoing embodiments, the third leg is serpentine.

In a further embodiment of any of the foregoing embodiments, the bypass leg connects to an axial outlet in the radially outer platform.

A further embodiment of any of the foregoing embodiments includes an aft blade outer air seal that is aft of the ceramic vane, and the cooling passage circuit includes a fourth leg in the aft blade outer air seal that is connected with the bypass leg.

In a further embodiment of any of the foregoing embodiments, the blade outer air seal is aft of the ceramic vane.

In a further embodiment of any of the foregoing embodiments, the ceramic vane includes radially inner and outer platforms and an airfoil section that extend there between, and the cooling passage circuit includes a radial inlet in the inner platform and an axial outlet in the outer platform.

In a further embodiment of any of the foregoing embodiments, the ceramic vane includes radially inner and outer platforms and an airfoil section that extend there between, and the cooling passage circuit includes an axial inlet in the outer platform and a radial outlet in the inner platform.

A gas turbine engine according to an example of the present disclosure includes a compressor section that has a tap for providing cooling air, a combustor in fluid communication with the compressor section and a turbine section in fluid communication with the combustor. The turbine section has a first component, a second component that is formed of ceramic and that is axially aft of the first component, and a cooling passage circuit that extends through the first component and the second component. The cooling passage circuit is configured to deliver the cooling air into the first component where the cooling air is heated to provide pre-heated cooling air, and then deliver the pre-heated cooling air from the first component into the second component.

In a further embodiment of any of the foregoing embodiments, the first component is a vane and the second component is a blade outer air seal.

In a further embodiment of any of the foregoing embodiments, the first component is a blade outer air seal and the second component is a vane.

In a further embodiment of any of the foregoing embodiments, the ceramic vane includes radially inner and outer platforms and an airfoil section that extend there between, and further includes an interface seal sealing the cooling passage between the blade outer air seal and the radially outer platform.

In a further embodiment of any of the foregoing embodiments, the cooling passage circuit includes a bypass leg.

In a further embodiment of any of the foregoing embodiments, the cooling passage circuit includes a serpentine section.

A further embodiment of any of the foregoing embodiments includes a third component aft of the second component, and the cooling passage circuit additionally extends in the third component.

A method for cooling a ceramic vane according to an example of the present disclosure includes providing a cooling passage circuit through first and second components in a turbine section of a gas turbine engine, and routing cooling air through the cooling passage circuit in the first component. The first component heats the cooling air to provide pre-heated cooling air. The pre-heated cooling air is then routed from the first component into the cooling passage circuit in the second component. The second component is formed of ceramic.

In a further embodiment of any of the foregoing embodiments, the first component is a blade outer air seal and the second component is a vane.

In a further embodiment of any of the foregoing embodiments, the cooling passage circuit includes a bypass leg and a serpentine section.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
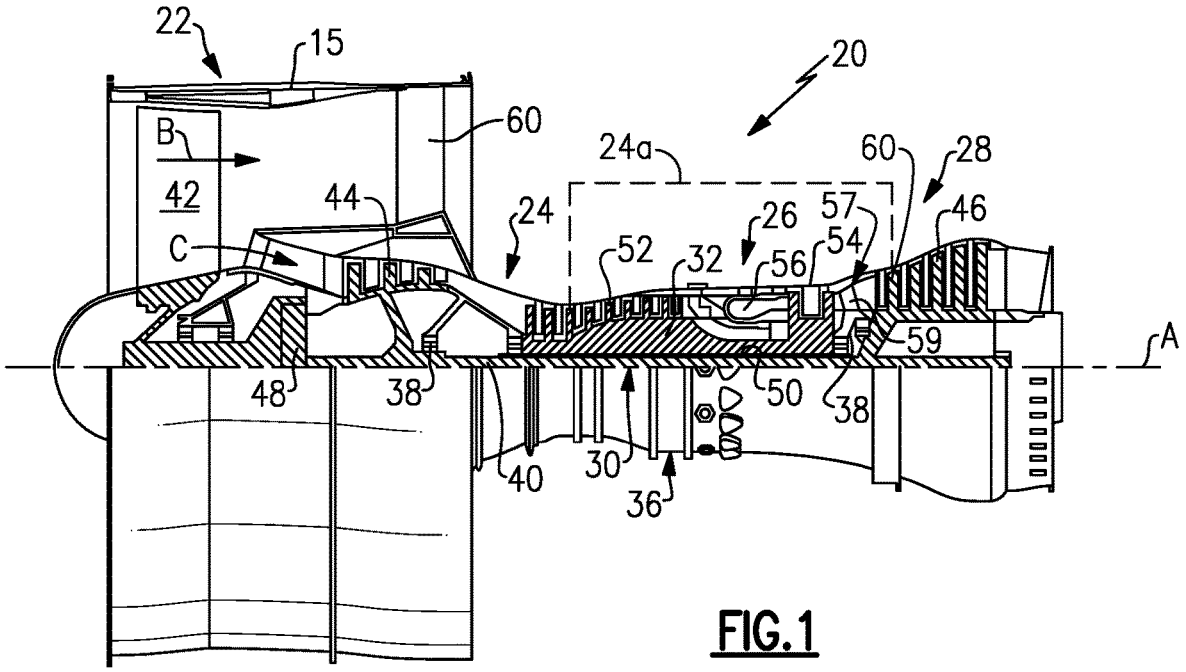
FIG. 1 illustrates a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a nacelle 15, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC)"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of [(Tram ° R)/(518.7° R)]^0.5. The "Low corrected fan tip speed" as disclosed herein according to one non-limiting embodiment is less than about 1150 ft/second (350.5 meters/second).

Figure 2:
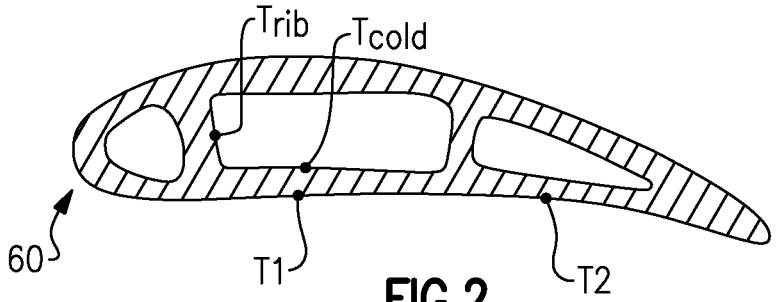
FIG. 2 illustrates a section view of an example component.

FIG. 2 illustrates an example component 60 from the turbine section 28 of the engine 20 in order to demonstrate aspects of the disclosure. In this example, the component 60 is a vane, although it is to be understood that the component 60 may alternatively be a blade outer air seal, for example. The component 60 is formed of ceramic. The ceramic may be a monolithic ceramic or a ceramic matrix composite ("CMC"). Example ceramic material may include, but is not limited to, silicon-containing ceramics. The silicon-containing ceramic may be, but is not limited to, silicon carbide (SiC) or silicon nitride ($Si_3N_4$). An example CMC may be a SiC/SiC CMC in which SiC fibers are disposed within a SiC matrix. As used herein, "formed of" refers to the structural self-supporting body of the component 60, rather than a conformal body such as a coating.

In general, components that are formed of ceramic present thermal management challenges that are unlike metallic components. Metallic alloys have relatively high strength and ductility. Thus, although metallic components are often cooled, the ductility enables the metallic components to withstand high thermal gradients between exterior surfaces in the core gas path and interior surfaces that are cooled. Ceramic materials have relatively higher thermal resistance, but lower thermal conductivity and lower ductility in comparison to metallic materials. As a result, cooling a ceramic component may actually be detrimental to durability because high thermal gradients may cause thermal stresses that exceed the limits of the ceramic.

For instance, FIG. 2 shows relative temperatures T1, T2, Trib, and Tcold at different locations in the component 60 (such as during cruise). A thermal gradient between any two points can be calculated or estimated as the quotient of the temperature difference between the points divided by the distance along the wall or walls between the points. Unless indicated otherwise, the thermal gradient may be represented in units of degree Celsius per millimeter. A thermal gradient can be measured experimentally and/or estimated via computer simulation. The points T1 and T2 are on the exterior surface of the wall of the component 60, directly in the core gas path C. The point Trib is in the middle portion of an internal rib in the component 60, and the point Tcold is at the internal surface of the wall opposite of the point T1. For example, thermal gradients due to the temperature differences (T1–Trib), (T1–Tcold), and (T2–T1) which exceed a threshold of the ceramic may reduce durability of the component 60. The thermal gradient may manifest in through-wall thickness, bulk temperature differences between different structures (e.g., a rib and an adjacent external wall), and/or in the plane of a wall. If relatively cool air, such as bleed air from the compressor section 24, is used directly to cool the component 60, the above thermal gradients may be exacerbated. For instance, the thermal gradients may be temperature differences of at least 150° C., 200° C., 300° C., or more than 400° C.

In this regard, as will be discussed below, the compressor section 24 includes a tap 24*a* (see also FIG. 1) for providing cooling air to a cooling passage circuit that serves to pre-heat the cooling air before the cooling air is provided into the ceramic component. The pre-heated cooling air provides a cooling effect in the component but enables the component to maintain lower thermal gradients, particularly in structural locations such as ribs or support or attachment features, in comparison to non-pre-heated cooling. The non-limiting examples below demonstrate various configurations. In this disclosure, like reference numerals designate like elements where appropriate and reference numerals with the addition of one-hundred or multiples thereof designate modified elements that are understood to incorporate the same features and benefits of the corresponding elements.

Figure 3:
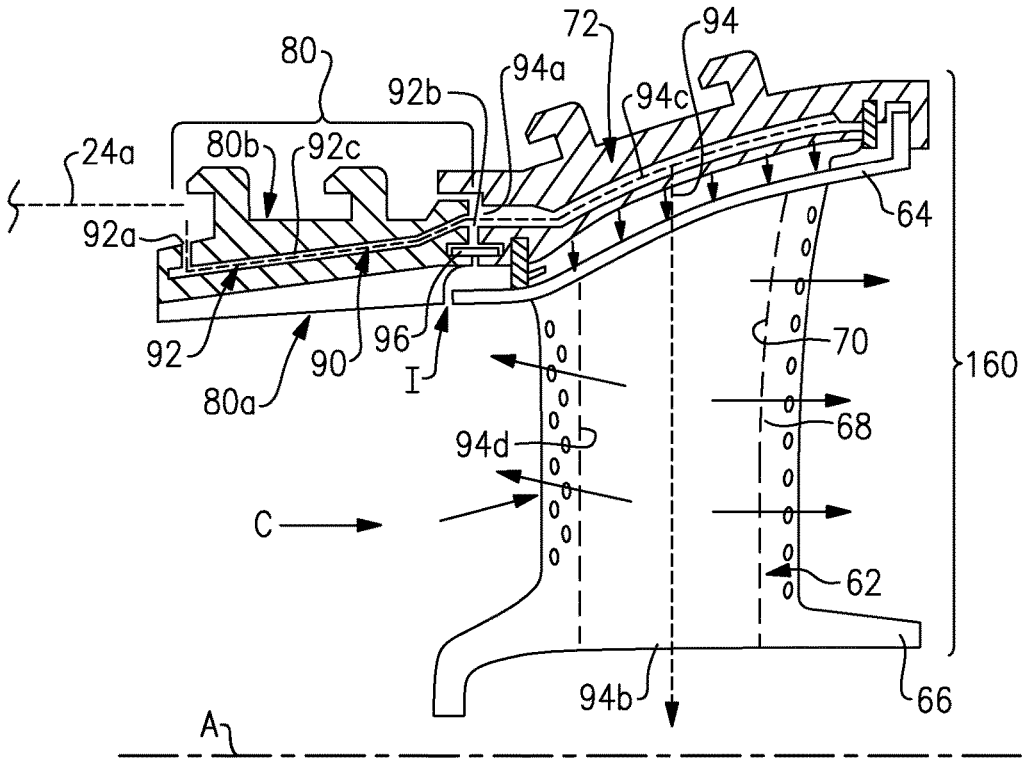
FIG. 3 illustrates an example in which cooling air is pre-heated in a blade outer air seal prior to being received into a ceramic vane.

FIG. 3 illustrates a component 160. In this example, the component 160 is a vane arc segment that is situated in a circumferential row about the engine central axis A. The component 160 is comprised of an airfoil piece 62 that is formed of a ceramic as discussed above. The airfoil piece 62 includes several sections, including first and second platforms 64/66 and an airfoil section 68 that extends between the first and second platforms 64/66. The airfoil section 68 is hollow and defines one or more internal passages or cavities 70. In this example, the first platform 64 is a radially outer platform and the second platform 66 is a radially inner platform. The terminology "first" and "second" as used herein is to differentiate that there are two architecturally distinct components or features. It is to be further understood that the terms "first" and "second" are interchangeable in the embodiments herein in that a first component or feature could alternatively be termed as the second component or feature, and vice versa.

The component 160 further includes a structural support 72. For example, the structural support 72 may be a spar or a case structure. The structural support 72 portion may be formed of metal, such as a nickel- or cobalt-based superalloy.

Another component 80 is situated adjacent the component 160. In this example, the component 80 is a blade outer air seal and is located forward of the component 160. The component 80 may be considered to be a first component, and the component 160 may be considered to be a second component. The blade outer air seal includes a gas path side 80*a* and a non-gas path side 80*b*. The non-gas path side 80*b* may include hooks or other type or attachment features for supporting the blade outer air seal.

There is a cooling passage circuit 90 that extends through the component 80 (blade outer air seal) and the component 160 (vane arc segment). The cooling passage circuit 90 is comprised of a network of interconnected passages among the components 80/160. The passages and structures described in the cooling passage circuits herein are understood to route cooling air as discussed. It is thus to be understood that the description also embodies methods of routing the cooling air.

The cooling passage circuit 90 includes several circuit legs, or sections. In this example, a first leg 92 is in the component 80 and a second leg 94 is in the component 160. For instance, the first leg 92 includes an inlet 92*a*, an outlet 92*b*, and an internal passage 92*c* in the blade outer air seal. Here, the inlet 92*a* is a radial inlet and the outlet 92*b* is an axial outlet. The inlet 92*a* is connected to a cooling air source, such as the compressor section 24.

The second leg 94 includes an inlet 94*a*, an outlet 94*b*, a supply passage 94*c*, and an internal passage 94*d* in the airfoil section 68 (which here is the same as the internal passage 70). The inlet 94*a* and supply passage 94*c* are formed in part or in whole by the structural support 72. The supply passage 94*c* connects the inlet 94*a* with the internal passage 94*d* in the airfoil section 68. The internal passage 94*d* connects the supply passage 94 with the outlet 94*b*. For instance, the outlet 94*b* may be a port in the platform 66.

When the engine 20 is in operation, the cooling air source provides cooling air to the cooling passage circuit 90. The cooling air is initially provided through the inlet 92*a* and into the internal passage 92*c* in the component 80. The cooling air flows generally axially in the internal passage 92*c* and then exits the component 80 axially from the outlet 92*b*. The cooling air in the internal passage 92*c* picks up heat from the walls of the component 80, thereby substantially increasing the temperature of the cooling air before it exits the component 80 (as pre-heated cooling air). For example, the cooling air may increase in temperature by at least 50° C., by at least 100° C., or by more than 200° C.

The inlet 94*a* receives the pre-heated cooling air from the outlet 92*b* and feeds the pre-heated cooling air to the supply passage 94*c*. The pre-heated cooling air may pick up additional heat in the supply passage 94*c*, and thereby further increase in temperature. The supply passage 94*c* feeds the pre-heated cooling air into the internal passage 94*d* to cool the airfoil section 68. The airfoil section 68 may discharge a portion of the pre-heated cooling air for film cooling. The remaining pre-heated cooling air exits through the outlet 94*b*.

By first flowing through the component 80 to be pre-heated, the cooling air received into the component 160 is warmer than it otherwise would have been if received directly from the cooling air source. The relatively warmer pre-heated cooling air maintains at least a portion of the component 160 at a desired thermal gradient. For instance, if cooling air were used directly from the cooling air source, the internal surfaces of the component would be cooled to a greater degree, thereby creating relatively large thermal gradients as discussed above. As an example, thermal gradients in the component 160 may be maintained at a temperature differential of 400° C. or less, 300° C. or less, or 150° C. or less.

The outlet 92*b* and the inlet 94*a* are at an interface (I) between the components 80/160. The cooling passage circuit 90 may also include one or more interface seals 96 in the interface (I) to seal the cooling passage circuit 90 and limit escape of the cooling air into the core gas path C. For example, the interface seal 96 may be, but is not limited to, a feather seal.

Figure 4:
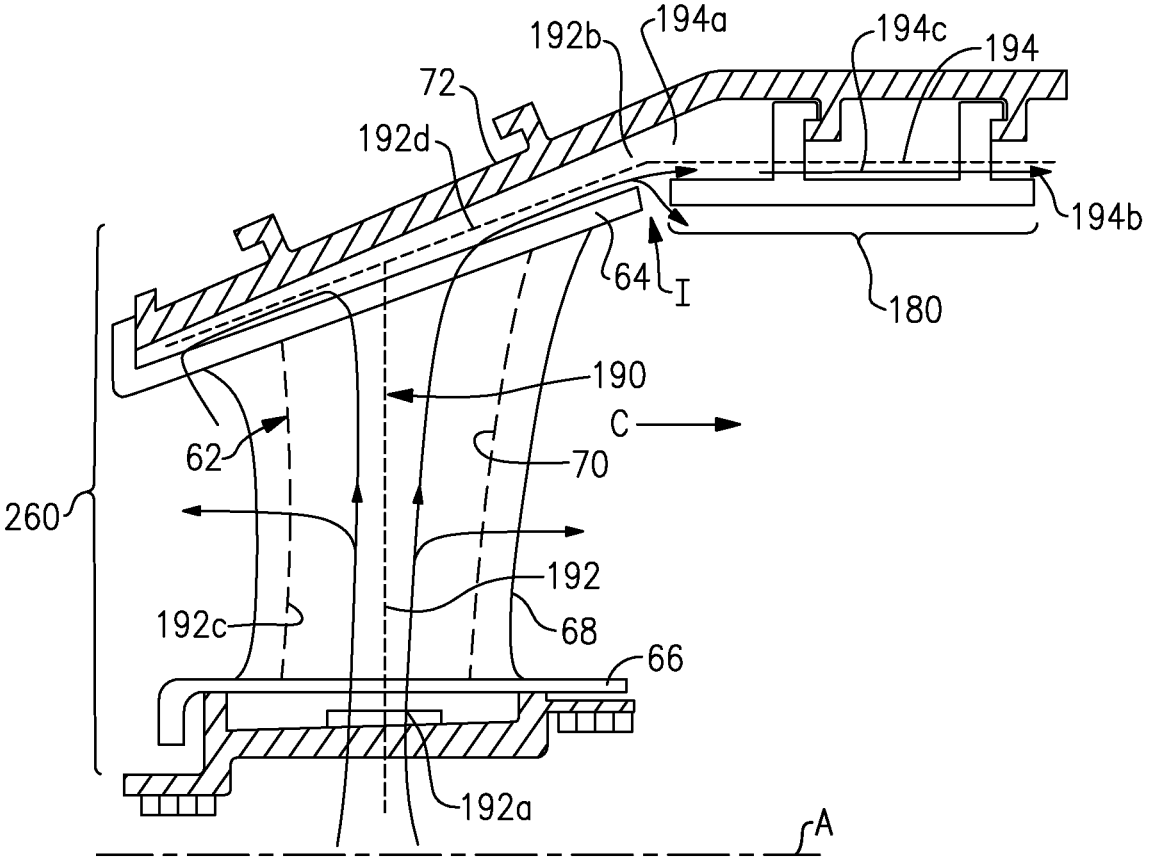
FIG. 4 illustrates an example in which cooling air is pre-heated in a vane prior to being received into a ceramic blade outer air seal.

FIG. 4 illustrates another example, in which component 180 is aft of component 260. In this example, the component 180 is a blade out air seal and the component 260 is a vane arc segment. At least the component 180 is formed of a ceramic as discussed above, but the airfoil piece 62 may also be formed of a ceramic as discussed above. There is a cooling passage circuit 190 that extends through the component 260 (vane arc segment) and the component 180 (blade outer air seal). In this example, the component 260 may be considered to be a first component, and the component 180 may be considered to be a second component.

The cooling passage circuit 190 includes several circuit legs, or sections. In this example, a first leg 192 is in the component 260 and a second leg 194 is in the component 180. For instance, the first leg 192 includes an inlet 192*a*, an outlet 192*b*, an internal passage 192*c* (which in this example is the internal passage 70), and a supply passage 192*d*. Here, the inlet 192*a* is a radial inlet or port in the platform 66 and the outlet 192*b* is an axial outlet. The inlet 192*a* is connected to a cooling air source, such as the compressor section 24. The internal passage 192*c* connects the inlet 192*a* with the supply passage 192*d*. The supply passage 192*d* connects the passage 192*c* with the outlet 192*b*. For instance, the supply passage 192*d* and the outlet 192*b* are formed in part or in whole by the structural support 72.

The second leg 194 includes an inlet 194*a*, an outlet 194*b*, and a passage 194*c*. The inlet 194*a*, outlet 194*b*, and passage 194*c* are formed in part or in whole by the blade outer air seal.

When the engine 20 is in operation, the cooling air source provides cooling air to the cooling passage circuit 190. The cooling air is initially provided through the inlet 192*a* and into the internal passage 192*c* in the component 260. The cooling air flows generally radially in the internal passage 192*c* and then into the supply passage 192*d*. The cooling air then exits the component 260 axially from the outlet 192*b*. The cooling air in the internal passage 192*c* and the supply passage 192*d* picks up heat from the walls of the component 260, thereby substantially increasing the temperature of the cooling air before it exits the component 260 (as pre-heated cooling air). For example, the cooling air may increase in temperature by at least 50° C., by at least 100° C., or by more than 200° C.

The inlet 194*a* receives the pre-heated cooling air from the outlet 192*b* and feeds the pre-heated cooling air to the passage 194*c* to cool the component 180. The pre-heated cooling air is then discharged from the component 180 through the outlet 194*b*. In this example, there is no interface seal in the interface (I) and a portion of the pre-heated cooling air may escape through the interface (I). The escape of the cooling air here may serve to purge the interface (I).

By first flowing through the component 260 to be pre-heated, the cooling air received into the component 180 is warmer than it otherwise would have been if received directly from the cooling air source. The relatively warmer pre-heated cooling air maintains at least a portion of the component 180 at a desired thermal gradient, similar to as discussed above.

Figure 5:
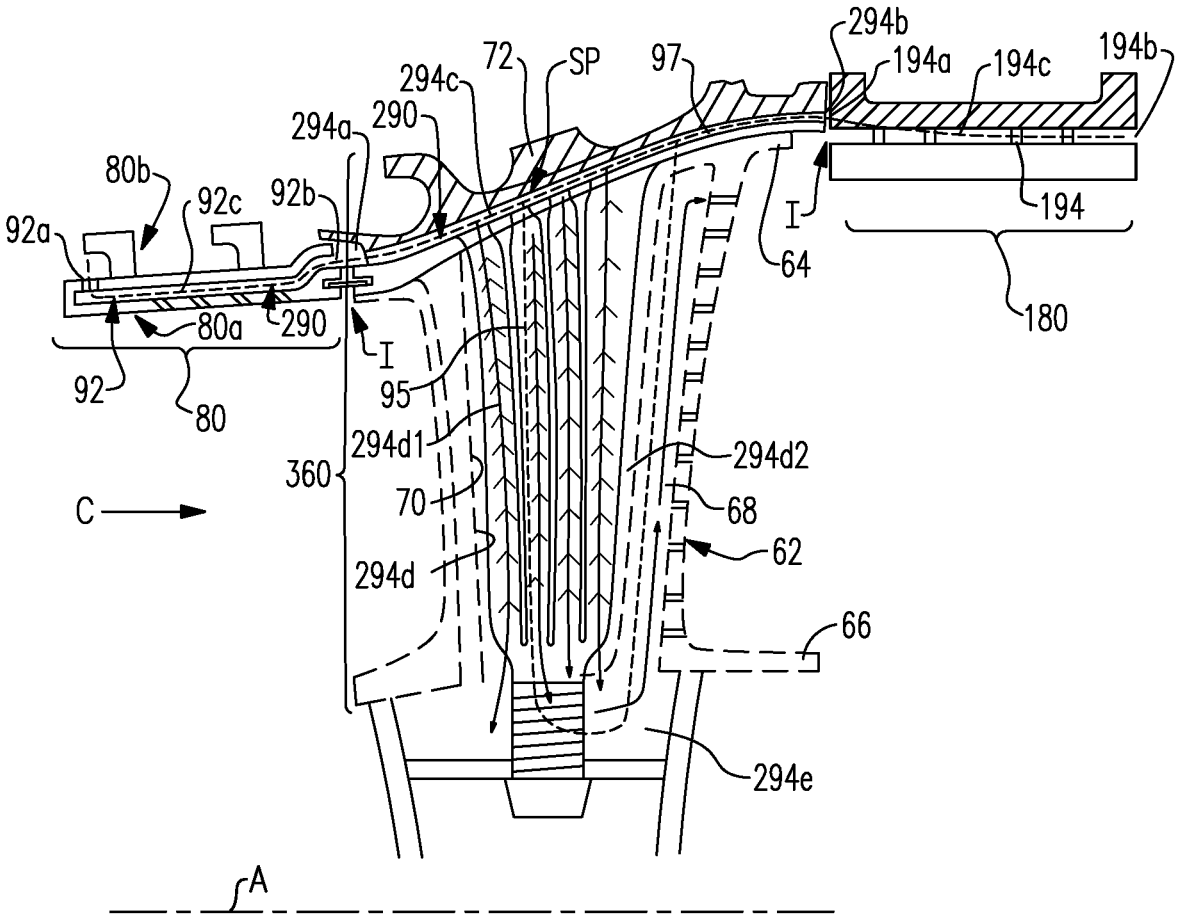
FIG. 5 illustrates an example in which cooling air is pre-heated in a forward blade outer air seal prior to being received into a ceramic vane, and where the cooling air is further pre-heated in the vane prior to being received into an aft ceramic blade outer air seal.

FIG. 5 illustrates a further example that is a modified combination of the prior examples. Here, components 80 and 180 are substantially as described above unless otherwise modified below. However, component 360 is configured to both receive the pre-heated cooling air from the component 80 and also deliver the further pre-heated cooling air to the component 180. In this example, at least the airfoil piece 62 is formed of a ceramic as discussed above, and the component 180 may also be formed of a ceramic as discussed above.

There is a cooling passage circuit 290 that extends through the component 80 (forward blade outer air seal), the component 360 (vane arc segment), and component 180 (aft blade outer air seal). The cooling passage circuit 290 includes several circuit legs, or sections. In this example, the first leg 92 is in the component 80 as discussed above. A second leg 294 extends in the radially outer platform 64 of the component 360. The second leg 294 splits, as represented at split (SP), into a third leg 95 in the airfoil section 68 and a bypass leg 97 that bypasses the airfoil section 62.

In this example, component 360 includes an inlet 294*a*, an outlet 294*b*, a supply passage 294*c*, an internal passage 294*d* (which in this example is the internal passage 70), and a turn section 294*e*. The second leg 294 includes the inlet 294*a* and a portion of the supply passage 294*c*. The supply passage 294*c* splits into the internal passage 294*d*. The remaining portion of the supply passage 294*c* continues past the split and serves as the structure for the bypass leg 97. The bypass leg 97 portion of the supply passage 294*c* connects to the outlet 294*b*.

The third leg 95 includes the internal passage 294*d* and the turn section 294*e*. The internal passage 294*d* includes at least one feed sub-passage 294*d*1 and at least one return sub-passage 294*d*2. The feed sub-passage 294*d*1 is connected to the supply passage 294*c* and the turn section 294*e*. The return sub-passage 294*d*2 is connected to the turn section 294*e* and the bypass leg 97 portion of the supply passage 294*c*. The feed sub-passage 294*d*1, the turn section 294*e*, and the return sub-passage 294*d*2 together form a serpentine as the third leg 95 of the cooling passage circuit 290.

The component 180 is substantially as described above, except that 194 represents a fourth leg of the cooling passage circuit 290.

The cooling air is pre-heated in the component 80 as described above and then fed to the inlet 294*a*. The pre-heated cooling air flows through the supply passage 294*c*. A portion of the cooling air splits off into the feed sub-passage 294*d*1 and a remaining portion of the cooling air continues to flow past the split into the bypass leg 97 portion of the supply passage 294*c*. The cooling air in the feed sub-passage 294*d*1 cools the airfoil section 68 and flows radially inwards toward the platform 66 and then into the turn section 294*e*. The turn section 294*e* redirects the cooling air, which then flows into the return sub-passage 294*d*2 to further cool the airfoil section 68. The return sub-passage 294*d*2 feeds the cooling air to the bypass leg 97 of the supply passage 294*c*, which then feeds the cooling air to the outlet 294*b*. The further pre-heated cooling air then flows into the component 180 as described above. The cooling air is thus twice pre-heated prior to being received into the component 180—a first pre-heating in the component 80 and a second pre-heating in the component 360.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A gas turbine engine comprising:

a blade outer air seal;

a ceramic vane including radially inner and outer platforms and an airfoil section that extends there between;

a cooling passage circuit extending through a first passage of the blade outer air seal and through a second passage of the ceramic vane, the cooling passage circuit including a first leg in the blade outer air seal and a second leg in the radially outer platform, the second leg splitting into a third leg in the airfoil section and a bypass leg that bypasses the airfoil section.

2. The gas turbine engine as recited in claim 1, wherein the ceramic vane includes radially inner and outer platforms and an airfoil section that extend there between, and further comprising an interface seal sealing the cooling passage between the blade outer air seal and the radially outer platform.

3. The gas turbine engine as recited in claim 1, wherein the blade outer air seal is forward of the ceramic vane.

4. The gas turbine engine as recited in claim 1, wherein the third leg is serpentine.

5. The gas turbine engine as recited in claim 4, wherein the bypass leg connects to an axial outlet in the radially outer platform.

6. The gas turbine engine as recited in claim 5, further comprising an aft blade outer air seal that is aft of the ceramic vane, and the cooling passage circuit includes a fourth leg in the aft blade outer air seal that is connected with the bypass leg.

7. The gas turbine engine as recited in claim 1, wherein the blade outer air seal is aft of the ceramic vane.

8. The gas turbine engine as recited in claim 1, wherein the ceramic vane includes radially inner and outer platforms and an airfoil section that extend there between, and the cooling passage circuit includes a radial inlet in the inner platform and an axial outlet in the outer platform.

9. The gas turbine engine as recited in claim 1, wherein the ceramic vane includes radially inner and outer platforms and an airfoil section that extend there between, and the cooling passage circuit includes an axial inlet in the outer platform and a radial outlet in the inner platform.

10. A gas turbine engine comprising:

a compressor section having tap for providing cooling air;

a combustor in fluid communication with the compressor section; and a turbine section in fluid communication with the combustor, the turbine section including a blade outer air seal, a ceramic vane including radially inner and outer platforms and an airfoil section that extends there between, and a cooling passage circuit extending through the blade outer air seal and the ceramic vane, the cooling passage circuit configured to deliver the cooling air into one of the blade outer air seal or the ceramic vane where the cooling air is heated to provide pre-heated cooling air, and then deliver the pre-heated cooling air from the one of the blade outer air seal or the ceramic vane into the other of the blade outer air seal or the ceramic vane, and an interface seal sealing the cooling passage between the blade outer air seal and the radially outer platform.

11. The gas turbine engine as recited in claim 10, wherein the cooling passage circuit includes a bypass leg.

12. The gas turbine engine as recited in claim 11, wherein the cooling passage circuit includes a serpentine section.

13. The gas turbine engine as recited in claim 10, further comprising a component aft of the ceramic vane, and the cooling passage circuit additionally extends in the component.

14. A gas turbine engine comprising:

a blade outer air seal;

a ceramic vane;

a cooling passage circuit extending through a first passage of the blade outer air seal and through a second passage of the ceramic vane.

15. The gas turbine engine as recited in claim 14, wherein the ceramic vane is a ceramic matrix composite and includes radially inner and outer platforms and an airfoil section that extend there between, and further comprising an interface seal sealing the cooling passage between the blade outer air seal and the radially outer platform.

16. The gas turbine engine as recited in claim 15, wherein the ceramic vane includes radially inner and outer platforms and an airfoil section that extend there between, and the cooling passage circuit includes a first leg in the blade outer air seal and a second leg in the radially outer platform, where the second leg splits into a third leg in the airfoil section and a bypass leg that bypasses the airfoil section.

17. The gas turbine engine as recited in claim 16, wherein the ceramic vane includes radially inner and outer platforms and an airfoil section that extend there between, and the cooling passage circuit includes a radial inlet in the inner platform and an axial outlet in the outer platform.

18. The gas turbine engine as recited in claim 16, wherein the ceramic vane includes radially inner and outer platforms and an airfoil section that extend there between, and the cooling passage circuit includes an axial inlet in the outer platform and a radial outlet in the inner platform.

* * * * *